US008797133B2

(12) United States Patent
Murillo et al.

(10) Patent No.: US 8,797,133 B2
(45) Date of Patent: Aug. 5, 2014

(54) TRANSFORMER WITH SHIELDING RINGS IN WINDINGS

(71) Applicant: ABB Technology AG, Zürich (CH)

(72) Inventors: Rafael Murillo, Saragossa (ES); Carlos Roy, Saragossa (ES); Jasmin Smajic, Schöfflisdorf (CH); Lise Donzel, Wettingen (CH); Jens Tepper, Brilon (DE); Jesús Letosa Fleta, Saragossa (ES); Antonio Usón, Saragossa (ES); Maria Teresa Villen, Saragossa (ES); Miguel Samplon, Saragossa (ES)

(73) Assignee: ABB Technology Ltd., Zurich (CH)

( * ) Notice: Subject to any disclaimer, the term of this patent is extended or adjusted under 35 U.S.C. 154(b) by 0 days.

(21) Appl. No.: 13/728,569

(22) Filed: Dec. 27, 2012

(65) Prior Publication Data

US 2013/0113598 A1 May 9, 2013

Related U.S. Application Data

(63) Continuation of application No. PCT/EP2011/060797, filed on Jun. 28, 2011.

(30) Foreign Application Priority Data

Jun. 28, 2010 (EP) ..... 10167483

(51) Int. Cl.
*H01F 27/32* (2006.01)

(52) U.S. Cl.
USPC ..... 336/84 C

(58) Field of Classification Search
USPC ..... 336/83, 84 C, 84 R, 212, 210, 206–208, 336/65
See application file for complete search history.

(56) References Cited

U.S. PATENT DOCUMENTS 2,937,349 A 5/1960 Guglielmo
3,142,029 A * 7/1964 Keen, Jr. et al. ..... 336/84 R (Continued)

FOREIGN PATENT DOCUMENTS

DE 474 029 C 3/1929
DE 10 11 984 B 7/1957

(Continued)

OTHER PUBLICATIONS

International Search Report (PCT/ISA/210) issued on Jul. 28, 2011, by the European Patent Office as the International Searching Authority for International Application No. PCT/EP2011/060797.

(Continued)

*Primary Examiner* — Tuyen Nguyen
(74) *Attorney, Agent, or Firm* — Buchanan Ingersoll & Rooney PC

(57) ABSTRACT

A coil and electric shielding arrangement for a dry-type transformer includes an electric shielding device arranged at a distance from a winding, at an axial end of the winding perpendicular to a longitudinal axis of the transformer, and parallel to a top surface of a coil that is wound around the axis such that the electric shielding device covers a cross-sectional area of the winding perpendicular to the longitudinal axis. An insulation material attached to the winding and to the electric shielding device establishes a first distance between the winding and the electric shielding device along the longitudinal axis such that the winding is shielded against another electric field. The winding and the electric shielding device are casted in a block which insulates the electric shielding device from the electric field of the winding by establishing a second distance between the winding and the electric shielding device.

13 Claims, 2 Drawing Sheets

(56) References Cited

U.S. PATENT DOCUMENTS

| | | | | |
|---|---|---|---|---|
| 3,327,268 | A | 6/1967 | Rabus | |
| 4,318,066 | A * | 3/1982 | Degeneff et al. | 336/70 |
| 5,990,775 | A | 11/1999 | Inui et al. | |
| 8,085,121 | B2 * | 12/2011 | Hanov | 336/84 C |
| 2010/0007452 | A1 | 1/2010 | Forsberg et al. | |

FOREIGN PATENT DOCUMENTS

| | | | |
|---|---|---|---|
| DE | 25 05 085 | A1 | 8/1976 |
| WO | WO 2008/026992 | A1 | 3/2008 |

OTHER PUBLICATIONS

Written Opinion (PCT/ISA/237) issued on Jul. 28, 2011, by the European Patent Office as the International Searching Authority for International Application No. PCT/EP2011/060797.

International Preliminary Report on Patentability (PCT/IPEA/409) issued on Jun. 26, 2012, by the European Patent Office as the International Searching Authority for International Application No. PCT/EP2011/060797.

Search Report issued on Oct. 5, 2010, by the European Patent Office for Application No. 10167483.6.

* cited by examiner

TRANSFORMER WITH SHIELDING RINGS IN WINDINGS

RELATED APPLICATIONS

This application is a continuation under 35 U.S.C. §120 of International Application PCT/EP2011-060797 filed on Jun. 28, 2011, designating the U.S., and claiming priority to European Application EP10167483.6 filed in Europe on Jun. 28, 2010, the content of each application is hereby incorporated by references in its entirety.

FIELD

The disclosure relates to electric shielding of transformers such as a coil and electric shielding arrangement for a transformer, a transformer with the arrangement, and the method of manufacturing a coil and electric shielding arrangement for a transformer.

BACKGROUND INFORMATION

Transformers can be widely used for low, medium, and high voltage applications.

In known dry type transformers, for example, the high voltage to low voltage insulation is made by an air space, with or without solid barriers being the high voltage and low voltage coils being surrounded by solid insulation. The electric field in the air is found at the top and bottom edges of the windings.

SUMMARY

An exemplary coil and electric shielding arrangement for a dry-type transformer is disclosed, the electric shielding arrangement comprising: a winding wound around a longitudinal axis of the transformer forming the coil; an electric shielding device arranged at a distance from the winding at an axial end of the winding perpendicular to the longitudinal axis and parallel to a top surface of the coil such that the electric shielding device covers a cross-sectional area of the winding perpendicular to the longitudinal axis; and an insulation material attached to the winding and to the electric shielding device, the insulation material establishing a first distance between the winding and the electric shielding device along the longitudinal axis such that the winding is shielded against another electric field, wherein the winding and the electric shielding device are casted in a block which insulates the electric shielding device from the electric field of the winding by providing a second distance between the winding and the electric shielding device.

An exemplary transformer is disclosed, comprising: an arrangement including: a winding wound around a longitudinal axis of the transformer forming the coil; an electric shielding device arranged at a distance to the winding at an axial end of the winding perpendicular to the longitudinal axis and parallel to a top surface of the coil such that the electric shielding device covers a cross-sectional area of the winding perpendicular to the longitudinal axis; and an insulation material attached to the winding and to the electric shielding device, the insulation material establishing a first distance between the winding and the electric shielding device along the longitudinal axis such that the winding is shielded against another electric field, wherein the winding and the electric shielding device are casted in a block which insulates the electric shielding device from the electric field of the winding by providing a second distance between the winding and the electric shielding device; at least two limbs; a yoke connecting the at least two limbs; and a clamp attached at the yoke and stabilizing the yoke, wherein the winding is arranged around at least one of the at least two limbs.

An exemplary method of manufacturing a coil and electric shielding arrangement for a transformer is disclosed, the method comprising the steps: winding a winding of the transformer around a longitudinal axis of the transformer forming the coil; arranging an electric shielding device at a first distance from the winding, on an axial end of the winding perpendicular to the longitudinal axis, and parallel to a top surface of the coil such that the electric shielding device covers a cross-sectional area of the winding perpendicular to the longitudinal axis; attaching an insulation material to the winding and to the electric shielding device establishing a second distance between the winding and the electric shielding device along the longitudinal axis; and casting the winding and the electric shielding in a block which insulates the electric shielding device from the electric field of the winding by providing a distance between the winding and the electric shielding device.

BRIEF DESCRIPTION OF THE DRAWINGS

The subject-matter of the disclosure will be explained in more detail in the following text with reference to exemplary embodiments which are illustrated in the attached drawings.

The reference signs used in the drawings, and their meanings, are listed in summary form in a list of reference signs. In principle, identical parts are provided with the same reference signs in the figures.

DETAILED DESCRIPTION

Figure 1:
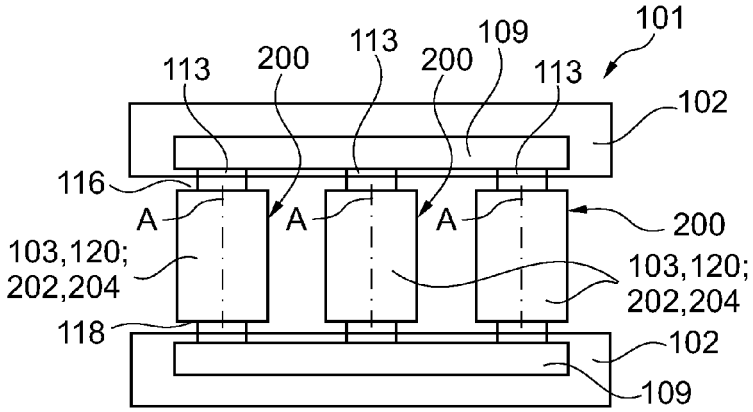
FIG. 1 schematically shows a cross-sectional view of a transformer with a coil and electric shielding arrangement in accordance with an exemplary embodiment of the present disclosure.

Exemplary embodiments of the present disclosure can increase a dielectric strength of a transformer.

Exemplary embodiments disclosed herein provide a coil and electric shielding arrangement for a transformer, a transformer with the arrangement, and a method of manufacturing a coil and electric shielding arrangement for a transformer.

According to one exemplary embodiment of the disclosure, a coil and electric shielding arrangement for a transformer is provided with a winding wound around a longitudinal axis of the transformer forming the coil or the cylindrical shaped coil, an electric shielding device which is arranged at a distance to the winding at an axial end of the winding perpendicular to the longitudinal axis and parallel to the top surface of the coil which can be a cylindrical-shaped coil such that the electric shielding device covers the cross-section area of the winding perpendicular to the longitudinal axis, and an insulation material attached to the winding and to the electric shielding device providing the distance between the winding and the electric shielding device along the longitudinal axis such that an environment of the winding is shielded against the electric field of the winding, wherein the winding and the electric shielding device are casted in a block which insulates the electric shielding device from the electric field of the winding by providing a distance between the winding and the electric shielding device.

In other words, an electric shielding device, e.g. in form of an open ring, can be arranged at one axial end of the winding. Such an electric shielding device can also be arranged at another axial end of the winding. The electric shielding device(s) can be arranged between the winding and the yokes of the winding, and can smooth the electric field generated by the winding to the outside of the winding. The winding can be a winding arrangement and can include more than one coil such as a high voltage coil and a low voltage coil. The electric shielding device thus can shield the electric fields of the high voltage winding or generated by the high voltage winding and of the low voltage winding or generated by the low voltage winding from each other, such that the electric field inside the windings is shielded as well as the electric field generated by the high voltage and low voltage windings to the environment of the high voltage and low voltage windings. The insulation material can surround or can be molded to the winding and the electric shielding device(s). The winding and the electric shielding device(s) can be casted or encapsulated in a block.

Electric shielding devices can be located at a first end and at a second end of the winding only in a high voltage winding or both in a high voltage winding and a low voltage winding such that the electric field of the windings or generated by the windings is smoothed. The electric field within the solid insulation close to the electric shielding device, e.g. a shielding ring, can be smoothed. The sudden change in permittivity from the insulation material, which can be a resin, to air that can lead to an electric field distortion in the air can be smoothed by avoiding sharp edges in the areas close to the winding edges (close to the shielding rings) by rounding the edges of the insulation material e.g. the resin. Thus the electric field of the windings or generated by the windings is smoothed by a combination of electric shielding rings plus rounded edges in the near area.

Such an arrangement with one or more electric shielding devices can improve the initial voltage distribution, when the transformer is subjected to any high voltage surge such as a lightning impulse. With the above described arrangement an improvement of breakdown voltage between 25-30% compared to a transformer without the arrangement can be achieved. The transformer can be applicable at a 72.5 kV level or at a level below 72.5 kV or at a level above 72.5 kV. The transformer can be a dry-type transformer.

According to another embodiment of the disclosure the electric shielding device(s) include(s) first rounded edges not facing the winding and second rounded edges facing the winding, wherein the radius of the first rounded edges and the radius of the second rounded edges are adapted such that an electric shielding of the environment of the winding is provided by the electric shielding device.

The electric shielding device(s) with first and/or second rounded edges can improve the shielding capacity of the electric shielding device(s) such that the electric field of the winding or generated by the winding to the outside of the winding can be smoothed even better than by electric shielding device(s) without rounded edges.

According to another exemplary embodiment of the disclosure the first rounded edges have a radius of 5 to 20 mm, in particular 10 mm, and the second rounded edges have a radius of 2 to 5 mm, in particular 3 mm.

The inner radii of the second rounded edges close to the conductor or the winding can be smaller than the outer radii of the first rounded edges, for example 2 or 3 mm for the inner and between 5-20 mm for the outer radii. Electric shielding devices, for example with a rectangular bar with rounded edges (radii 3-5 mm), or with a rounded wire (radii 3-5 mm) can be manufactured. Thus a high voltage transformer can be effectively shielded. The electric shielding device can be open in some point in order to avoid a closed loop which can evoke a short circuit. Electric shielding device(s) with rounded edges with the above mentioned radii can shield an electric field of the winding to the environment of the winding more efficiently compared to other above mentioned radii or compared to electric shielding device(s) with non-rounded edges.

According to another exemplary embodiment of the disclosure the electric shielding device is electrically connected to the winding.

The electric shielding device can be electrically connected to the winding at the beginning, and at any intermediate location of the winding or the electric shielding device can be electrically floating.

According to another exemplary embodiment of the disclosure, the distance between the winding and the electric shielding device is between 5 and 40 mm.

With such a distance between 5 and 40 mm the shielding of the electric field of the winding to the environment of the winding by the electric shielding device(s) can be optimized compared to other distances.

According to still another exemplary embodiment of the disclosure, the electric shielding device has an open ring shape or an annular shape.

An electric shielding device with an open ring shape avoids a closed loop, which can evoke a short circuit, and can thus provide for an effective and optimized shielding of the electric field of the winding to the environment of the winding.

According to another exemplary embodiment of the disclosure, the winding and the electric shielding device can be casted in a block which insulates the electric shielding device from the electric field of the winding by providing a distance of 5 to 40 mm between the winding and the electric shielding device. The casted block includes rounded edges near the electric shielding device with radii corresponding to the radii of the first rounded edges of the electric shielding device, in particular radii of 5 to 15 mm. The electric field generated by the windings is smoothed by a combination of the electric shielding device with the first rounded edges and the rounded edges of the cast block near the first rounded edges.

According to another exemplary embodiment of the disclosure, the cross-section of the electric shielding device is selected from the group of polygonal cross-sections with rounded edges, of semi-elliptical like cross-sections, or of a circular cross-section.

The electric shielding device can have the form of a rounded wire with cross-sectional radii of 3-5 mm.

The above mentioned cross-sections of the electric shielding device, such as the semi-elliptical like cross-section, can provide for a better and more efficient shielding of the electric field of the winding to the environment of the winding compared to other cross-sections of the electric shielding device.

According to another embodiment of the disclosure, the electric shielding device includes a non-conductive material frame covered by a layer of a conductive material.

The layer of conductive material can be much thinner than the material frame.

By providing an electric shielding device with a non-conductive material frame covered by a layer of a conductive material the shielding capacity and/or shielding characteristic of the electric shielding device concerning the shielding of an electric field of the winding to the environment of the winding can be improved or optimized compared to an electric shielding device without such a non-conductive material frame covered by a layer of a conductive material. The much thinner conductive material compared to the material frame thickness can further improve the shielding characteristic of the electric shielding device.

According to an exemplary embodiment of the disclosure, the winding is a high voltage winding and/or a low voltage winding, wherein the electric shielding device covers the cross-section area of the high voltage winding and/or the low voltage winding perpendicular to the longitudinal axis.

The electric shielding device thus can shield the electric fields of the high voltage winding or generated by the high voltage winding and of the low voltage winding or generated by the low voltage winding from each other, such that the electric field inside the windings is shielded as well as the electric field generated by the high voltage and low voltage windings to the environment of the high voltage and low voltage windings.

According to an exemplary embodiment of the disclosure, the cross-section of the attached insulation material comprises rounded edges.

The radius of the rounded edges can have the same size as the radius of the first rounded and/or second rounded edges. Thus the electric field within the solid insulation close to the electric shielding device, can be smoothed. The sudden change in permittivity from the insulation material, which can be a resin, to air that can lead to an electric field distortion in the air can be smoothed by avoiding sharp edges in the areas close to the winding edges (close to the shielding rings) by rounding the edges of the insulation material e.g. the resin. Thus the electric field of the windings or generated by the windings is smoothed by a combination of electric shielding rings plus rounded edges in the near area.

According to another exemplary embodiment of the disclosure, the arrangement further comprises a low voltage winding with a second shielding device and an insulating barrier. The insulating barrier is provided between the high voltage winding and the low voltage winding and is adapted to stop charge avalanche between the high voltage winding and the low voltage winding.

The inclusion of insulating barriers between two parts under voltage can increase the electric field and thus the voltage they can support without having any discharge. The effect of the barriers can be explained with their property of stopping the free charges which can initiate a discharge, limiting the path, the velocity and the energy of the charges. A given distance of air can withstand more voltage if the total space of air is split to smaller sections. The barriers can have the form of a cylinder and can be made of glass fiber composite film which can have a thickness of 3 mm and can be adapted to act as an electric barrier and as a mechanical support.

Additional insulation can be obtained with the same turns of insulating film which can have a thickness of 1 mm. The number of barriers can depend on the total air distance between the high voltage and low voltage windings, ranging from 3-6, or even more for high air distances. The air spaces can be between 20-50 mm and the barriers can be uniformly distributed between high voltage and low voltage windings such that the air space is similar.

In order to minimize the electric field, such as for high voltage windings, the electric shielding ring can have a few more or few less millimeters than the inner high voltage winding diameter (e.g. 4 mm). In order to minimize the electric field, the low voltage winding (shielding ring) will have a few more or few less millimeters than the outer low voltage winding diameter (e.g. 4 mm).

If the windings are rounded (with a diameter between 5 and 20 mm) the electric field is smooth and the distance between both windings could be reduced. The shape can be achieved during manufacturing or mechanized after the winding is done. Regarding the thickness of the solid insulation around the windings it can be around 10 mm in both high voltage and low voltage windings except on the ends of the high voltage and low voltage windings, where it can be around 20 mm.

Any sharp edge, even if it is an insulation material, can increase the electric field in the given configuration. This effect can appear in the edges at the ends of the windings in a transformer, and it can be even worse because of a uniformity in the electric field in this area. An electric shielding device with rounded edges can smooth the electric field inside the windings, meaning between high voltage and low voltage windings, and in order to have the same effect in the air close to the ends of the windings, the epoxy resin can have rounded edges with approximately the same radius of the first rounded edges for example 10 mm.

According to another exemplary embodiment of the disclosure, a transformer is provided with an arrangement of anyone of the above-mentioned exemplary embodiments, at least two limbs, a yoke connecting the at least two limbs, and a clamp attached at the yoke and stabilizing the yoke. The winding is arranged around at least one of the at least two limbs.

The above and below mentioned exemplary electric shielding arrangement is applicable to dry transformers with a voltage level above 70 kV effectively shielding the dry transformer from the electric field generated by the winding of the dry transformer. Thus a dry transformer with HV winding designed as HV disc winding with a voltage level of 70 kV and above can be built as compact as a dry transformer with a lower voltage level. There can be higher field strength in the region between the HV winding and the LV winding and/or the yoke and particularly higher field peaks at the HV disc winding and the edges of the LV winding and/or the yoke compared to a dry transformer with a voltage level below 70 kV specifying a higher dielectric strength. This specified higher dielectric strength can be provided by the electric shielding device or electric shielding devices which can homogenize the electric field to the ground by a multi-part shielding of the high voltage and/or low voltage windings. Thus parts of the transformer such as the yoke are prevented from overheating or losing the specified mechanical strength due to discharges of the electric field to the edges of the yoke by the electric shielding device. The electric shielding device can increase the breakdown voltage and can lead to an improvement of shielding between HV and LV windings of the transformer coil and the yoke compared to a transformer with HV and/or LV windings without an electric shielding device.

According to an exemplary embodiment of the disclosure, the transformer further includes a second electric shielding device which is arranged at the yoke between the yoke and a winding of the transformer and is adapted for shielding the yoke from an electric field of the winding. The transformer further includes an electric shielding element which is arranged at the clamp between the clamp and the winding of the transformer and which is adapted for shielding the clamp from an electric field of the winding.

In other words, a cover can be arranged at the yoke facing the windings of the transformer and thereby shielding the yoke from an electric field of the windings. The second electric shielding device can act as an electrostatic shield or as a protective shield in order to shield the sharp edges of the yoke itself and all other edges related to the yoke such as edges of yoke laminations, so smoothing the electric field of the transformer with respect to the yoke. This shielding cover is kept bare, not covered by any insulation film. The shielding cover can be insulated according to another exemplary embodiment of the disclosure. The yoke is adapted for connecting at least two limbs. More than one yoke can be provided. The winding can be arranged around at least one of the at least two limbs. The above and below mentioned exemplary electric shielding arrangement is applicable to dry transformers with a voltage level above 70 kV effectively shielding the yoke of the dry transformer from the electric field generated by the winding of the dry transformer. Thus a dry transformer with HV winding designed as HV disc winding with a voltage level of 70 kV and above can be built as compact as a dry transformer with a lower voltage level. There can be higher field strength in the region between the HV winding and the yoke and higher field peaks at the HV disc winding and the edges of the yoke compared to a dry transformer with a voltage level below 70 kV specifying a higher dielectric strength. This specified higher dielectric strength can be provided by the second electric shielding device or second electric shielding devices which can homogenize the electric field to the ground by a multi-part shielding of the yoke. Thus the yoke is prevented from overheating or losing its specified mechanical strength due to discharges of the electric field to the edges of the yoke by the second electric shielding device.

The second electric shielding device can increase the breakdown voltage and can lead to an improvement of shielding between winding of the transformer coil and the yoke compared to a yoke without a second electric shielding device.

According to another exemplary embodiment of the disclosure, the second electric shielding device has a shape corresponding to the shape of the yoke such that the yoke is covered by the second electric shielding device. The shape can be partly cylindrical or oval layer like or can be any shape which is adjusted to the edges.

According to another exemplary embodiment of the disclosure, the second electric shielding device includes a layer shape adapted to avoid sharp edges.

According to still another exemplary embodiment of the disclosure the second electric shielding device includes a conductive material.

In an exemplary embodiment of the disclosure, the second electric shielding device includes a thin rectangular piece of one of aluminum and copper and can be ground connected. According to yet another embodiment, the second electric shielding device is connected to the metallic structure of the transformer (the clamps).

The second electric shielding device can include a mixture of aluminum and copper. The second electric shielding device can include any other conductive material such as carbon steel or non-magnetic steel, and/or can include semiconductive material, since semiconductive material would also smooth the electric field. According to another embodiment of the disclosure a dielectric shielding of the yoke from an electric field of the winding is provided by the second electric shielding device, which can be a copper sheet or copper foil, and/or an insulating layer applied at the yoke, the insulating layer possibly having a high epsilon, for example an epsilon of 10. Thus the electric field at the yoke can be smoothed.

According to another exemplary embodiment of the disclosure, the yoke is a split yoke, including a first yoke part and a second yoke part, wherein the second electric shielding device includes a first electric shielding element and a second electric shielding element. The first electric shielding element is arranged at the first yoke part between the first yoke part and the winding of the transformer. The second electric shielding element is arranged at the second yoke part between the second yoke part and the winding of the transformer. The first electric shielding element is adapted for shielding the first yoke part from an electric field of the winding, and the second electric shielding element is adapted for shielding the second yoke part from an electric field of the winding.

In other words, a yoke can be split in two halves, a first yoke part, and a second yoke part. A first and second electric shielding element, possibly in form of covers, can be arranged at the first and second yoke parts facing the windings of the transformer and thereby shielding the first and second yoke parts from an electric field of the windings. The first and second electric shielding elements can act as electrostatic shields or as protective shields in order to shield the sharp edges of the first and second yoke parts themselves and all other edges related to the first and second yoke parts such as edges of first and second yoke laminations, so smoothing the electric field of the transformer with respect to the first and second yoke parts. This shielding covers can be kept bare, not covered by any insulation film. The shielding covers can be insulated according to another embodiment of the disclosure. The first and second yoke parts are adapted for connecting at least two limbs. More than one first and second yoke parts can be provided. The winding can be arranged around at least one of the at least two limbs. A yoke cooling duct can be present between the first and the second yoke part for cooling the transformer by cooling agents such as oil or air or water. According to an exemplary embodiment of the disclosure the cooling agent is air.

The electric shielding element for the clamp can be a cover that can be placed on a clamp facing the winding, and the cover can act as an electrostatic shield or as a protective shield in order to shield the sharp edges of the clamp itself and all other metallic edges related to the clamp, so smoothing the electric field of the transformer with respect to the clamps. This shielding cover is kept bare, not covered by any insulation film. The shielding cover can be insulated according to another embodiment of the disclosure. The clamp is adapted for holding together or mechanically fixing or stabilizing a yoke of the transformer to the coil(s) of the transformer. The electric shielding element can cover the clamp and/or can have a vat- or trough-like form covering the clamp.

The above mentioned electric shielding element is applicable to dry transformers with a voltage level above 70 kV effectively shielding the clamp of the dry transformer from the electric field generated by the winding of the dry transformer. Thus a dry transformer with HV winding designed as HV disc winding with a voltage level of 70 kV and above can be built as compact as a dry transformer with a lower voltage level. There can be higher field strength in the region between the HV winding and the clamp and particularly higher field peaks at the HV disc winding and the edges of the clamp compared to a dry transformer with a voltage level below 70 kV specifying a higher dielectric strength. This specified higher dielectric strength can be provided by the electric shielding element which can homogenize the electric field to the ground such that the clamp is prevented from overheating or losing its specified mechanical strength due to discharges of the electric field to the edges of the clamp by the electric shielding element.

The electric shielding element can include a material selected from the group consisting of steel, and aluminum, and any other conducting material with stabilizing mechanical properties.

The electric shielding element can increase the breakdown voltage and can lead to a 25% improvement of shielding between winding of the transformer coil and the clamps compared to clamps without an electric shielding element according to impulse voltage tests.

The clamp can have rounded edges forming a rounded clamp that can have the function of the electric shielding element, shielding the clamp from an electric field generated by the winding or windings of the transformer.

According to another embodiment of the disclosure the electric shielding element includes rounded edges.

Such an electric shielding element with rounded edges can smooth an electric field of the winding of a transformer with respect to the transformer clamp by avoiding field peaks or discharges at edges of the clamp, thus preventing the clamp from overheating or losing its specified mechanical strength.

According to another exemplary embodiment of the disclosure, a method of manufacturing a coil and electric shielding arrangement for a transformer is provided, including (e.g., comprising) the steps of: winding a winding of the transformer around a longitudinal axis of the transformer forming the coil which can be a cylindrical-shaped coil, arranging an electric shielding device at a distance to the winding at an axial end of the winding perpendicular to the longitudinal axis and parallel to the top surface of the coil such that the electric shielding device covers the cross-section area of the winding perpendicular to the longitudinal axis, attaching an insulation material to the winding and to the electric shielding device providing the distance between the winding and the electric shielding device along the longitudinal axis.

These and other aspects of the present disclosure will become apparent from and elucidated with reference to the exemplary embodiments described hereinafter.

FIG. 1 schematically shows a cross-sectional view of a transformer with a coil and electric shielding arrangement in accordance with an exemplary embodiment of the present disclosure. For example, FIG. 1 schematically shows a view of a transformer 101 with a coil and electric shielding arrangement 200 for each phase of the transformer 101 with windings 103, 202 each wound around a longitudinal axis A of the transformer 101 forming coils which can be cylindrical-shaped coils, an electric shielding device 120, 204 which is arranged at a distance to the winding 103, 202 at an axial end 116, 118 of the winding 103, 202 perpendicular to the longitudinal axis A and parallel to the top surface of the coils such that the electric shielding device 120, 204 covers the cross-section area of the winding 103, 202 perpendicular to the longitudinal axis A, and an insulation material attached to the winding 103, 202 and to the electric shielding device 120, 204 providing a distance between the winding 103, 202 and the electric shielding device 120, 204 along the longitudinal axis A such that an environment of the winding 103, 202 is shielded against the electric field of the winding 103, 202 (see also FIG. 2 to FIG. 4). Two yokes 109 connect the three core limbs 113 of the transformer 101, each yoke 109 being mechanically stabilized by two clamps 102. The windings 103, 202 are arranged around each core limb 113. The electric shielding device 120, 204 can improve the initial voltage distribution, if the transformer 101 is subjected to any high frequency voltage surge such as a lightning impulse.

A first electric shielding device 120 can be arranged at a first end 116 of the winding 103,202 and/or at a second end 118 of the winding 103, 202. A first electric shielding device 120 can be arranged at a first end 116 and/or at a second end 118 of a high voltage winding 103, and a second electric shielding device 204 can be arranged at a first end 116 and/or at a second end 118 of a low voltage winding 202. The high voltage winding 103 and/or the low voltage winding 202 can be a foil winding 103, 202.

The transformer 101 for example a dry-type transformer 101 having the above described coil and electric shielding arrangement 200, is applicable at voltage level of 72.5 kV and at a voltage level above.

Figure 2:
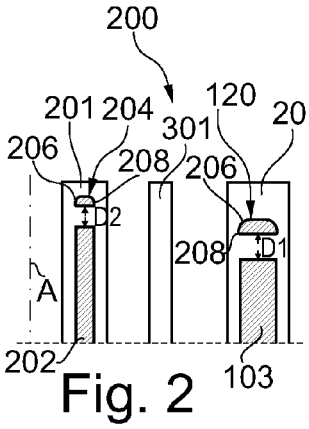
FIG. 2 schematically shows a cross-sectional view of a first coil and electric shielding arrangement for a transformer with a low voltage winding and a high voltage winding in accordance with an exemplary embodiment of the present disclosure.

FIG. 2 schematically shows a cross-sectional view of a first coil and electric shielding arrangement for a transformer with a low voltage winding and a high voltage winding in accordance with an exemplary embodiment of the present disclosure. For example, FIG. 2 schematically shows a cross-sectional view of one of the coil and electric shielding arrangements 200 shown in FIG. 1 with a low voltage winding 202 and a high voltage winding 103. An insulation material 201 is attached to the high voltage winding 103 and the first electric shielding device 120, wherein the first electric shielding device 120 is arranged at a distance D1 to the high voltage winding 103 which can be between 15 to 40 mm. The insulation material 201 is attached as well to the low voltage winding 202 and the second electric shielding device 204, wherein a distance D2 between the low voltage winding 202 and the second electric shielding device 204 of about 5 to 40 mm is provided. The coil and electric shielding arrangement 200 provides for a shielding of an electric field generated by the high voltage winding 103 and by the low voltage winding 202 to the environment of the high voltage winding 103 and the low voltage winding 202 and for a shielding between the high voltage winding 103 and the low voltage winding 202. The first electric shielding device 120 and the second electric shielding device 204 include first rounded edges 206 not facing the windings 103, 202 and second rounded edges 208 facing the windings 103, 202. The first rounded edges 206 can have a radius of 5-20 mm, for example, and more preferably of 10 mm, and the second rounded edges 208 can have a radius of 2-5 mm, for example, and more preferably 3 mm. The radius of the first rounded edges 206 and the radius of the second rounded edges 208 are adapted such that an electric shielding of the environment of the winding 103, 202 is provided by the electric shielding device 120, 204. An insulating barrier 301 is provided between the high voltage winding 103 and the low voltage winding 202 in a direction parallel to the axis A and is adapted to stop charge avalanche between the high voltage winding 103 and the low voltage winding 202. The insulation material 201 is for example an epoxy resin. The high voltage winding 103 and/or the low voltage winding 202 can be a foil winding 103, 202.

Figure 3:
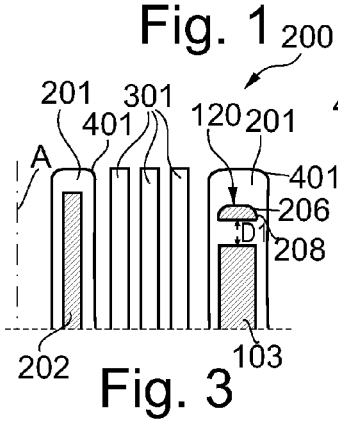
FIG. 3 schematically shows a cross-sectional view of a second coil and electric shielding arrangement for a transformer with a low voltage winding and a high voltage winding in accordance with an exemplary embodiment of the present disclosure.

FIG. 3 schematically shows a cross-sectional view of a second coil and electric shielding arrangement for a transformer with a low voltage winding and a high voltage winding in accordance with an exemplary embodiment of the present disclosure. For example, FIG. 3 schematically shows a cross-sectional view of the coil and electric shielding arrangement 200 of FIG. 2, with the difference, that the low voltage winding 202 is not shielded by a second electric shielding device. There are three insulating barriers 301 arranged between the high voltage winding 103 and the low voltage winding 202 to stop charge avalanche between the high voltage winding 103 and the low voltage winding 202. The cross-section of the attached insulation material 201 of the high voltage winding 103 and the low voltage winding 202 includes rounded edges 401. The radius of the rounded edges 401 can have the same size as a radius of the first rounded edges 206 of FIG. 2, if the exemplary embodiments of FIG. 2 and FIG. 4 are combined.

Figure 4:
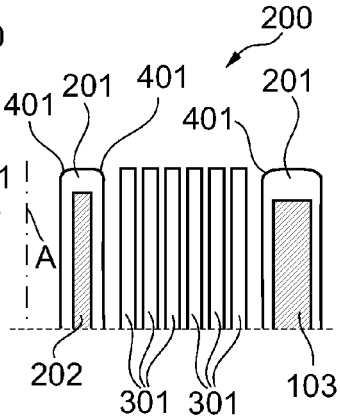
FIG. 4 schematically shows a cross-sectional view of a third coil and electric shielding arrangement for a transformer with a low voltage winding and a high voltage winding in accordance with an exemplary embodiment of the present disclosure.

FIG. 4 schematically shows a cross-sectional view of a third coil and electric shielding arrangement for a transformer with a low voltage winding and a high voltage winding in accordance with an exemplary embodiment of the present disclosure. For example, FIG. 4 schematically shows a cross-sectional view of the winding 103, 202 and the electric shielding device arrangement 200 of FIG. 2 with the difference, that neither the low voltage winding 202 nor the high voltage winding 103 is shielded by a first electric shielding device or a second electric shielding device. The cross-section of the attached insulation material 201 of the high voltage winding 103 and the low voltage winding 202 includes rounded edges 401. The radius of the rounded edges 401 can have the same size as a radius of the first rounded edges 206 of FIG. 2, if the exemplary embodiments of FIG. 2 and FIG. 4 are combined. FIG. 4 includes six insulating barriers 301 between the high voltage winding 103 and the low voltage winding 202 stop charge avalanche between the high voltage winding 103 and the low voltage winding 202.

Figure 5:
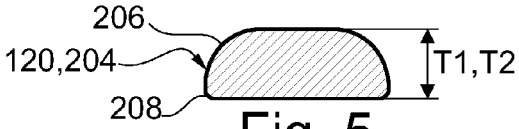
FIG. 5 schematically shows a cross-sectional view of an electric shielding device in accordance with an exemplary embodiment of the present disclosure.

FIG. 5 schematically shows a cross-sectional view of an electric shielding device in accordance with an exemplary embodiment of the present disclosure. For example, FIG. 5 schematically shows a cross-sectional view of an electric shielding device 120, 204, which can have an open ring form. The cross-section of the electric shielding device 120, 204 is a rectangular bar cross-section with first rounded edges 206 with a radius of 10 mm and second rounded edges 208 of a radius of 3 mm and a thickness T1, T2 of approximately 15 mm. The electric shielding device 120, 204 can be a first electric shielding device 120 or a second electric shielding device 204, for example, or both. The first rounded edges 206 can have a radius of 5-10 mm, for example, and the second rounded edges 208 can have a radius of 2-5 mm, for example. The electric shielding device can have a cross-section of a rounded wire with radii of 3-5 mm, for example, or a cross-section selected from the group of polygonal cross-sections with rounded edges 206, 208, or semi-elliptical like cross-sections, or of a circular cross-section according to further exemplary embodiments of the disclosure (partly shown in FIG. 5).

Figure 6:
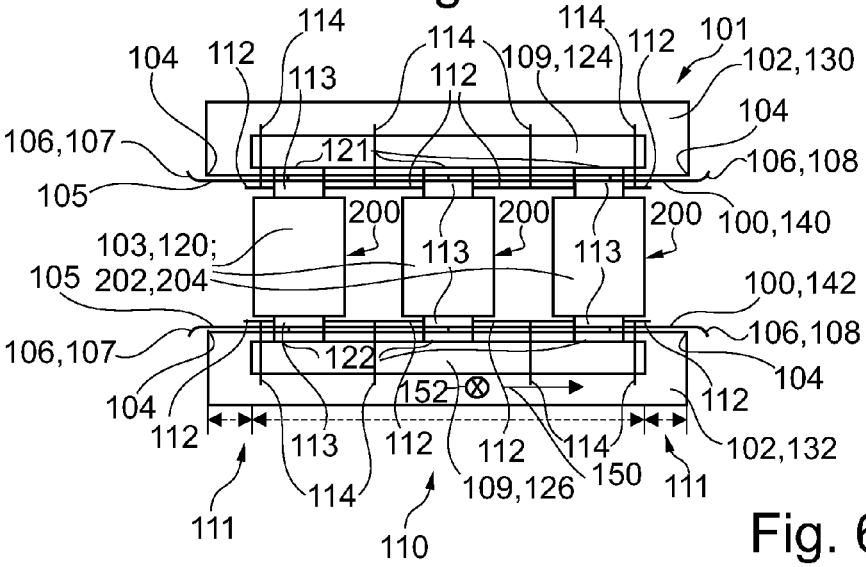
FIG. 6 schematically shows a cross-sectional view of a coil and electric shielding arrangement for a transformer with a second electric shielding device for shielding a yoke of the transformer and an electric shielding element for shielding a clamp the transformer in accordance with an exemplary embodiment of the present disclosure.

FIG. 6 schematically shows a cross-sectional view of a coil and electric shielding arrangement for a transformer with a second electric shielding device for shielding a yoke of the transformer and an electric shielding element for shielding a clamp the transformer in accordance with an exemplary embodiment of the present disclosure. For example, FIG. 6 schematically shows a view of the coil and electric shielding arrangement 200 for the transformer 101 of FIG. 1 with a second electric shielding device 112 which is arranged at the yoke 109 between the yoke 109 and a winding 103 of the transformer 101 and is adapted for shielding the yoke 109 from an electric field of the winding 103. An electric shielding element 100 is arranged at the clamp 102 between the clamp 102 and the winding 103 of the transformer 101 and is adapted for shielding the clamp 102 from an electric field of the winding 103.

The yoke 109, 124, 126 connects limbs 113. The second electric shielding device 112 is arranged at the yoke 109, 124, 126 covering the yoke 109 between the yoke 109 and a winding 103 of the transformer 101. The second electric shielding device 112 is adapted for shielding the yoke 109, 124, 126 from an electric field of the winding 103.

The second electric shielding device 112 can be a rounded cover or an electrostatic shield being placed onto the yoke 109, 124, 126 in an area facing the winding 103 of the transformer 101 and is adapted to shield the sharp edges of the yoke 109, 124, 126 and thus smoothing the electric field of the transformer 101. The second electric shielding device 112 can be covered with an insulation film.

The second electric shielding device 112 can be adapted to shield the yoke 109, 124, 126 from a winding 103 of the transformer 101, when the arrangement is mounted to the transformer 101, thus smoothing an electric field between the windings 103 and the yoke 109, 124, 126 of the transformer 101.

The second electric shielding device 112 can have a cylindrical or an oval layer shape or a shape corresponding to the shape of the yoke 109, 124, 126 such that the yoke 109, 124, 126 is covered by the second electric shielding device 112. The second electric shielding device 112 can further include a layer shape adapted to avoid sharp edges.

The second electric shielding device 112 can have a conductive material and can be a thin rectangular piece of aluminum or copper or a mixture thereof or can have a semiconductive material, and can be ground connected by a ground connecting device 114.

The ground connecting device 114 is adapted to ground connect the second electric shielding device 112 to ground potential.

The second electric shielding device 112 can include an insulating film covering the second electric shielding device 112 in order to avoid a short circuit between yoke steel plates that would lead to higher limb 113 losses.

The cover with an insulating material or film of the second electric shielding device 112 can increase the electric field that the second electric shielding device 112 can withstand without the development of a discharge. The insulating film can be a semitransparent insulating film.

The second electric shielding device 112 can include a first electric shielding element part and a second electric shielding element part which are separate from each other, meaning that the second electric shielding device 112 can be separated in several parts.

The transformer 101 is adapted for electrically shielding the windings 103, which can be high voltage or low voltage windings 103, from the yoke 109, 124, 126.

The transformer 101 of FIG. 6 is applicable at a 72.5 kV level and at a level higher than a 72.5 kV level.

The clamp 102, 130, 132 is attached at the yoke 109, 124, 126, and stabilizes the yoke 109, 124, 126 of the transformer 101, and an electric shielding element 100, 140, 142 is arranged at the clamp 102, 130, 132 between the yoke 109, 124, 126 and a winding 103 of the transformer 101. The electric shielding element 100, 140, 142 is adapted for shielding the clamp 102, 130, 132 from an electric field of the winding 103. The clamp 102, 130, 132 is adapted for holding together or mechanically fixing the yoke 109, 124, 126 of the transformer 101. The yoke 109, 124, 126 connects at least two limbs 113 of the transformer 101. The electric shielding element 100, 140, 142 can include rounded edges 105, 106.

The electric shielding element 100, 140, 142 can project over the clamp edges 104.

The transformer 101 includes at least two limbs 113, such as three limbs 113, each having (e.g., comprising) a first limb end 120 and a second limb end 122. A winding 103 is arranged around at least one of the at least two limbs 113, in an exemplary embodiment as shown a winding 103 is arranged at three limbs 113. A first yoke 109, 124 connects the three limbs 113 at the first limb ends 120. A second yoke 109, 126 connects the three limbs 113 at the second limb ends 122. First clamps 102, 130 are attached at the first yoke 109, 124 to stabilize the first yoke 109, 124, and second clamps 102, 132 are attached at the second yoke 109, 124 to stabilize the second yoke 109, 126. First electric shielding elements 100, 140 are arranged at the first clamps 102, 130 between the first yoke 109, 126 and three windings 103 each of the windings 103 arranged around each of the three limbs 113. Second electric shielding elements 100, 142 are arranged at the second clamps 102, 132 between the second yoke 109, 126 and the three windings 103.

First rounded edges 105 are arranged at a longitudinal side 150 of the clamp 102, 130, 132 facing the windings 103 of the transformer 101, wherein the windings 103 can be high voltage or low voltage windings. The longitudinal side 150 can be horizontal, and parallel to the yoke 109, 124, 126 limb 113 connecting side and perpendicular to the limbs 113 as indicated in FIG. 1. The first rounded edges 105 can arranged at clamp edges 104 which can be metallic clamp edges 104 related to the clamp 102, 130, 132. The electric shielding element 100, 140, 142 acts as an electrostatic shield to shield the sharp clamp edges 104 itself and all other metallic clamp edges 104 related to the clamp 102, 130, 132, thus smoothing the electric field of the transformer 101.

Second rounded edges 106 are arranged at the first end 107 and at the second end 108 of the electric shielding element 100, 140, 142 at a transverse side 152 of the clamp 102, 130, 132. The transverse side 152 can be horizontal, perpendicular to the longitudinal side 150 and to a vertical side parallel to the limbs 113.

The first or second rounded edges 105, 106 can have a radius of 5-45 mm, for example, and more preferably 30 mm.

The first rounded edges 105 have a different radius at a first region 110 at a yoke 109, 109, 124, 126 of the transformer 101 then at a second region 111 that is not at the yoke 109, 124, 126. The electric shielding element 100, 140, 142 can be grounded by being connected to the clamp 102, 130, 132, for example by being welded to the clamp 102, 130, 132.

The first rounded edges 105 can have a length of ⅛ of a circumference of a sphere defined by the radius of the first rounded edges 105 or in other words the first rounded edges 105 can have a length of ⅛ of a sphere.

The electric shielding element 100, 140, 142 is arranged on all clamps 102, 130, 132 of the transformer 101, wherein the transformer 101 is adapted for electrically shielding the windings 103 which can be high voltage windings 103 or low voltage windings 103, or both, to the clamp 102, 130, 132. The transformer 101 can be a dry type transformer 101.

The exemplary embodiments of FIGS. 1 to 6 can be combined among each other. In all embodiments or combinations of embodiments of FIGS. 1 to 6 the electric shielding device 120, 204 can be electrically connected to the winding 103, 202, the distance D1, D2 between the winding 103, 202 and the electric shielding device 120, 204 can be between 5 to 40 mm, for example, the first rounded edges 206 can have a radius of 5 to 20 mm, for example, the second rounded edges 208 can have a radius of 2 to 5 mm, for example, the electric shielding device 120, 204 can have an open ring shape or an annular shape, the electric shielding device 120, 204 can include a non-conductive material frame covered by a layer of conductive material, the cross-section of the shielding device 102, 204 can be selected from the group of polygonal cross-sections with rounded edges 206, 208, of semi-elliptical like cross-sections, or of a circular cross-section, and the cross-section of the attached insulation material can comprise rounded edges 401.

Figure 7:
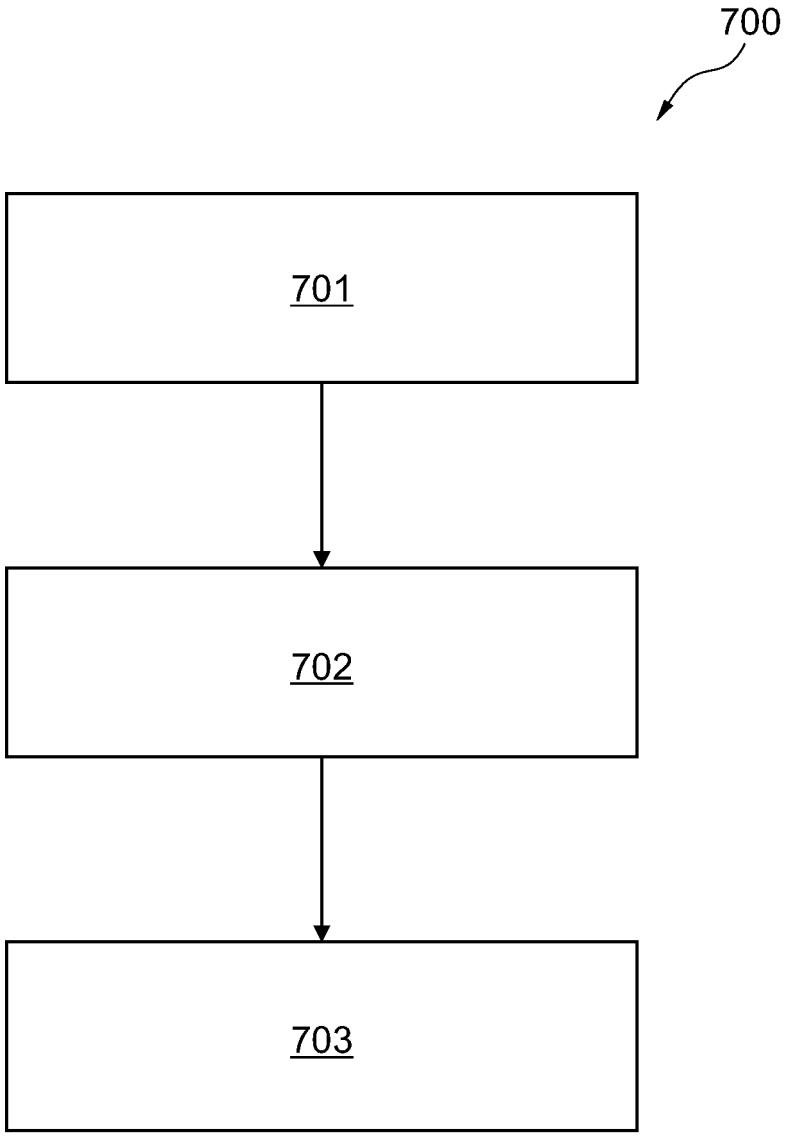
FIG. 7 schematically shows a flow chart of a method of manufacturing a coil and electric shielding arrangement for a transformer in accordance with an exemplary embodiment of the present disclosure.

FIG. 7 schematically shows a flow chart of a method of manufacturing a coil and electric shielding arrangement for a transformer in accordance with an exemplary embodiment of the present disclosure. For example, FIG. 7 schematically shows a flow chart of a method 700 of manufacturing a coil and electric shielding arrangement for a transformer. The method 700 includes the steps of winding a winding of the transformer around a longitudinal axis A of the transformer forming the coil which can be a cylindrical-shaped coil 701, arranging an electric shielding device at a distance to the winding at an axial end of the winding perpendicular to the longitudinal axis and parallel to the top surface of the coil such that the electric shielding device covers the cross-section area of the winding perpendicular to the longitudinal axis 702, attaching an insulation material to the winding and to the electric shielding device providing the distance between the winding and the electric shielding device along the longitudinal axis 703.

While the disclosure has been illustrated and described in detail in the drawings and the foregoing description, such illustration and description are to be considered illustrative or exemplary and not restricted; the disclosure is not limited to the disclosed exemplary embodiments.

Other variants of the disclosed exemplary embodiments can be understood and affected by those skilled in the art and practicing the claimed disclosure, from a study of the drawings, the disclosure, and the appended claims.

In the claims, the words "comprising", "including", and "having" do not exclude other elements or steps, and the indefinite article "a" or "an" does not exclude a plurality. A single coil and electric shielding arrangement, or a single yoke and clamp and electric shielding device arrangement, or a single transformer, a single yoke or clamp, or a single electric shielding device can fulfill the function of several items recited in the claims. The mere fact that certain measures are recited in mutually different dependent claims does not indicate that a combination of these measures cannot be used to advantage. Any reference signs in the claims should not be construed as limiting the scope.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

100 Electric shielding element
101 Transformer
102 Clamp
103 Winding, high voltage winding
104 Clamp edge(s)

105 Rounded edges, first rounded edges
106 Second rounded edges
107 First end (of the electric shielding element)
108 Second end (of the electric shielding element)
109 Yoke
110 First region (at the yoke)
111 Second region (that is not at the yoke)
112 Second electric shielding device
113 limb(s)
114 Ground connecting device
120 Electric shielding device, first electric shielding device
121 First limb end(s)
122 Second limb end(s)
124 First yoke
126 Second yoke
130 First clamp(s)
132 Second clamp(s)
140 First electric shielding element(s)
142 Second electric shielding element(s)
150 Longitudinal side (of the clamp)
152 Transverse side (of the clamp)
200 Coil and electric shielding arrangement, arrangement
201 Insulation material, attached insulation material
202 Winding, low voltage winding
204 Electric shielding device, second electric shielding device
206 First rounded edge(s)
208 Second rounded edge(s)
301 Insulating barrier(s)
401 Rounded edges (of attached insulation material)

What is claimed is:

1. A coil and electric shielding arrangement for a dry-type transformer, the electric shielding arrangement comprising:

a winding wound around a longitudinal axis of the transformer forming the coil;

an electric shielding device arranged at a distance from the winding at an axial end of the winding perpendicular to the longitudinal axis and parallel to a to surface of the coil such that the electric shielding device covers a cross-sectional area of the winding perpendicular to the longitudinal axis, the electric shielding device having first rounded edges not facing the winding, and second rounded edges facing the winding, wherein a radius of the first rounded edges and a radius of the second rounded edges are adapted such that an electric shielding of the winding is provided by the electric shielding device; and an insulation material attached to the winding and to the electric shielding device, the insulation material establishing a first distance between the winding and the electric shielding device along the longitudinal axis such that the winding is shielded against another electric field, wherein the winding and the electric shielding device are casted in a block which insulates the electric shielding device from the electric field of the winding by providing a second distance between the winding and the electric shielding device, wherein the casted block includes third rounded edges near the electric shielding device with radii corresponding to the radii of the first rounded edges of the electric shielding device, and wherein the electric field generated by the windings is smoothed by a combination of the electric shielding device with the first rounded edges and the third rounded edges of the cast block near the first rounded edges.

2. The arrangement of claim 1, wherein the first rounded edges have a radius of 5 to 20 mm and the second rounded edges have a radius of 2 to 5 mm.

3. The arrangement of claim 2, wherein the first round edges have a radius of 10 mm and the second rounded edges have a radius of 3 mm.

4. The arrangement of claim 1, wherein the electric shielding device is electrically connected to the winding.

5. The arrangement of claim 1, wherein the distance between the winding and the electric shielding device is between 5 to 40 mm.

6. The arrangement of claim 1, wherein the electric shielding device has an open ring shape or an annular shape.

7. The arrangement of claim 1, wherein the radii of the third rounded edges is between 5 to 15 mm.

8. The arrangement of claim 1, wherein a cross-section of the shielding device is selected from a group of polygonal cross-sections with rounded edges, semi-elliptical cross-sections, or a circular cross-section.

9. The arrangement of claim 1, wherein the winding includes at least one of a high voltage winding and a low voltage winding, and the electric shielding device covers a cross-sectional area of at least one of the high voltage winding and the low voltage winding perpendicular to the longitudinal axis.

10. The arrangement of claim 1, wherein a cross-section of the attached insulation material comprises rounded edges.

11. The arrangement of claim 9, comprising:

a low voltage winding with a second shielding device; and an insulating barrier, wherein the insulating barrier is provided between the high voltage winding and the low voltage winding and prevents charge avalanche between the high voltage winding and the low voltage winding.

12. The arrangement of claim 1, wherein the shielding device comprises a non-conductive material frame covered by a layer of conductive material.

13. A method of manufacturing a coil and electric shielding arrangement for a transformer, the method comprising the steps:

winding a winding of the transformer around a longitudinal axis of the transformer forming the coil;

arranging an electric shielding device at a first distance from the winding, on an axial end of the winding perpendicular to the longitudinal axis, and parallel to a top surface of the coil such that the electric shielding device covers a cross-sectional area of the winding perpendicular to the longitudinal axis, the electric shielding device being formed with first rounded edges not facing the winding, and second rounded edges facing the winding, wherein a radius of the first rounded edges and a radius of the second rounded edges are adapted such that an electric shielding of the winding is provided by the electric shielding device;

attaching an insulation material to the winding and to the electric shielding device establishing a second distance between the winding and the electric shielding device along the longitudinal axis; and casting the winding and the electric shielding in a block which insulates the electric shielding device from the electric field of the winding by providing a distance between the winding and the electric shielding device, the casted block including third rounded edges near the electric shielding device with radii corresponding to the radii of the first rounded edges of the electric shielding device, wherein combination of the electric shielding device with the first rounded edges and the third rounded edges of the cast block near the first rounded edges is configured to smooth the electric field generated by the windings.

* * * * *